US005184639A

United States Patent [19]

Lee

[11] Patent Number: 5,184,639

[45] Date of Patent: Feb. 9, 1993

[54] OPENING LOCK FOR A SUNSHADE

[76] Inventor: Chorng-Cheng Lee, No. 272, Lane 365, Fung Nan Road, Chiayi City, Taiwan

[21] Appl. No.: 886,897

[22] Filed: May 22, 1992

[51] Int. Cl.[5] ..... A45B 25/06

[52] U.S. Cl. ..... 135/28; 135/39; 135/40; 403/108; 403/328

[58] Field of Search ..... 135/15.1, 28, 37, 38, 135/39, 40; 403/108, 109, 328

[56] References Cited

U.S. PATENT DOCUMENTS

| | | | |
|---|---|---|---|
| 3,306,127 | 2/1967 | Rieger | 403/108 X |
| 3,377,966 | 4/1968 | Bates et al. | 403/108 X |
| 3,680,571 | 8/1972 | Houston | 135/40 X |
| 3,980,409 | 9/1976 | Turner | 403/108 |
| 4,317,387 | 3/1982 | Myers et al. | 403/108 X |
| 4,577,837 | 3/1986 | Berg et al. | 403/108 X |

FOREIGN PATENT DOCUMENTS

| | | | |
|---|---|---|---|
| 102191 | 7/1941 | Sweden | 403/328 |
| 191101 | 1/1923 | United Kingdom | 135/40 |

*Primary Examiner*—Richard E. Chilcot, Jr.
*Assistant Examiner*—Lan Mai
*Attorney, Agent, or Firm*—Browdy and Neimark

[57] ABSTRACT

An improved opening lock for use in a sunshade or a parasol which is housed in a cavity defined on the shaft of the sunshade. The present opening lock has a stop block having a smoothly curved guide bottom at the front end and a bias spring disposed behind the stop block and a fixing element for mounting the spring, and a cover plate which confines the stop block and the spring and the fixing element inside the cavity so that the runner of the sunshade slidably disposed on the shaft is able to move against the lock, pushing the lock into the cavity when the runner traveling upward to make the sunshade open, and the stop block is able to pop out when the runner passing the same and to support the runner in place, keeping the sunshade opened. To close the sunshade, the stop lock must be pushed into the cavity to permit the runner slide downward.

4 Claims, 6 Drawing Sheets

OPENING LOCK FOR A SUNSHADE

BACKGROUND OF THE INVENTION

1. Field of the Invention

The present invention relates to an improved opening lock particularly for use in a sunshade or a parasol. The opening lock comprises a cover plate and a stop block and a bias spring and a fixing element that are received in a cavity defined on the shaft of the sunshade. The cover plate is used to confine the other elements in the cavity with the stop block passing through an opening on the cover plate. The stop block has a smoothly curved guide bottom at the front end thereof and is disposed in front of the bias spring which is then limited in place by the fixing element thereby the stop block can be retractably actuated by the runner slidably disposed on the shaft of the sunshade when the runner is pushed upward against and over the opening lock and support the runner in place so as to make the sunshade open; and the same can be closed by simply pressing the stop block down and pulling the runner downward.

2. Description of the Prior Art

Referring to FIG. 1, the conventional sunshade 1 is equipped with a solid shaft 14 on which a runner 12 is slidably secured, and a top cover 15 which is extendably connected to the runner 12 by way of a plurality of stretching ribs 11, and a locking pin 131 attached by a chain 13 to one of the stretching rib 11 which is removably engaged with a through hole 141 disposed near the top of the solid shaft so that the runner 12 can be supported in place and keep the sunshade opened. To close the sunshade, the operator has to detach the locking pin from the shaft and let the runner travel downward so as to make the top cover collapse.

There are a number of disadvantages associated with this type of prior art sunshade which are presented as below:

1. The locking pin attached to one of the stretching rib by way of a chain is easily lost because the opening of the looped elements of the chain is readily pulled wide open, resulting in the detachment of the lockign pin therefrom; and a substitute must be used to replace the locking pin.

2. The top cover of the conventional sunshade is usually in bulky size and very heavy, the opening of the same is relatively inconvenient and must be performed by 2 persons, therefore the location of the through hole and insertion of the locking pin must be carried out in a hurry, and this is particularly true when the sunshade is operated by a single person. Therefore, the operation becomes relatively inconvenient with the conventional structure.

SUMMARY OF THE INVENTION

The primary object of the present invention is to provide an improved opening lock particularly for a sunshade or a parasol which is able to be easily and securely operated so as to facilitate the opening of a sunshade.

One further object of the present invention is to an improved opening lock for a sunshade which is equipped with a spring biased stop block housed in a cavity disposed on the shaft so that the same can be pushed into the cavity when run over by a runner of the sunshade and popped out after the runner passes the stop block so as to support the sunshade to open; and to close the same, the operator has only to press the stop block into the cavity and let the runner travel downward over the block.

BRIEF DESCRIPTION OF THE DRAWINGS

To make the features, operational modes and structure of the present opening lock better understood by people of this skill, a number of drawings are presented in company with a detailed description of a preferred embodiments thereof, in which.

DETAILED DESCRIPTION OF THE PREFERRED EMBODIMENT

Figure 1:
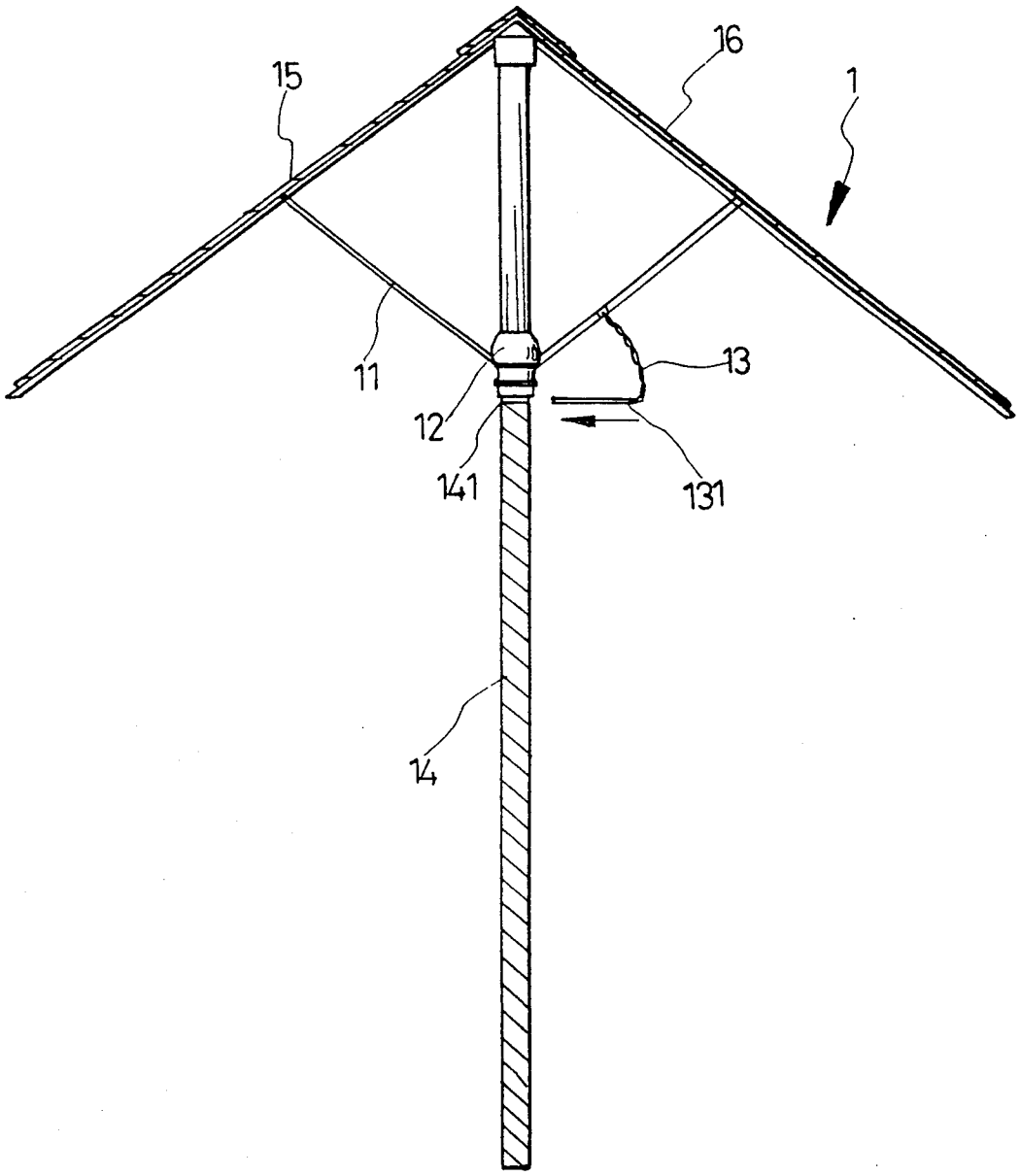
FIG. 1 PRIOR ART
FIG. 1 is a sectional view showing one conventional sunshade.
Figure 2:
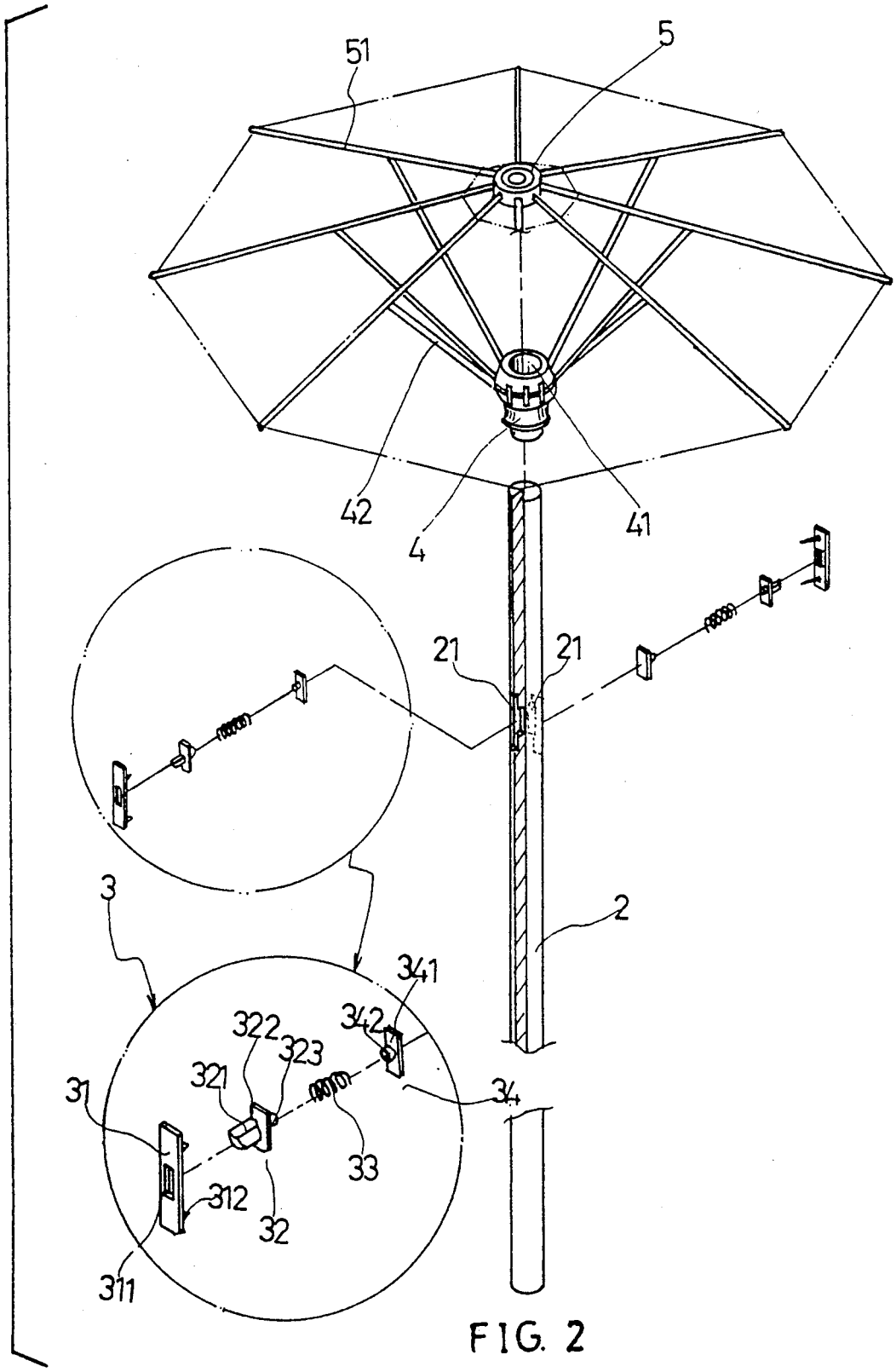
FIG. 2 is a diagram showing the exploded components of the present opening lock.
Figure 3:
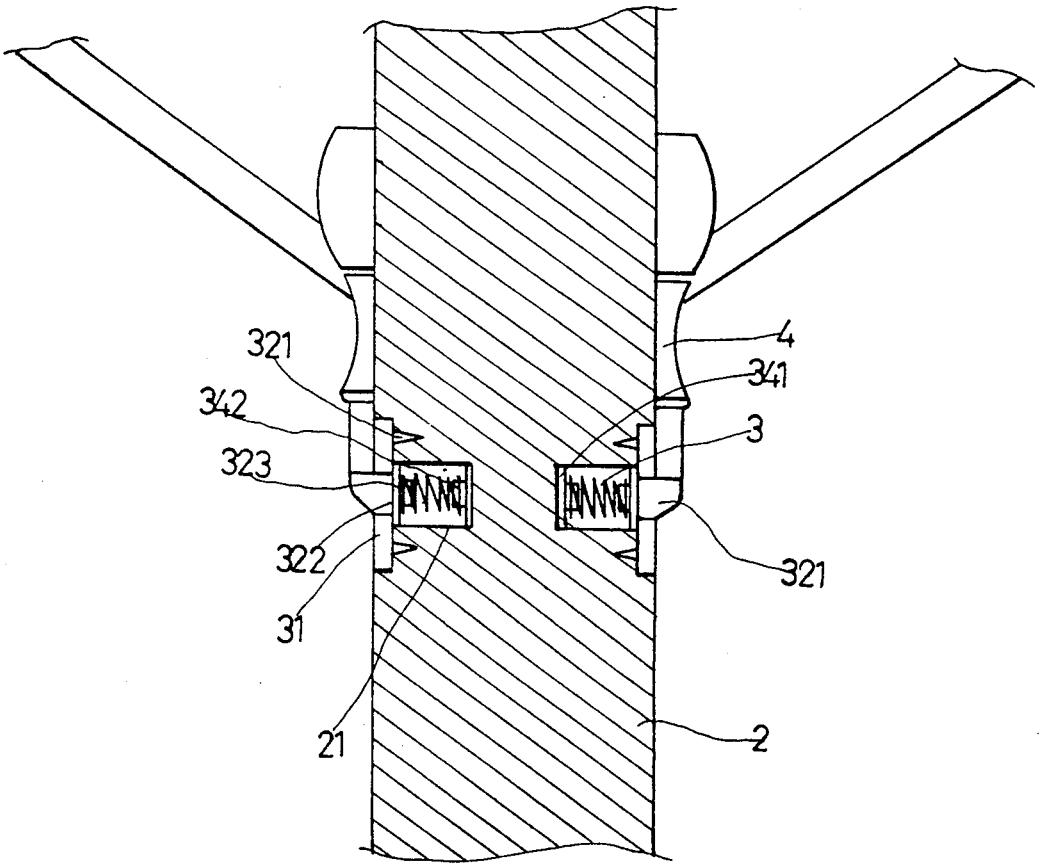
FIG. 3 is a sectional view of the present opening lock.

Referring to FIGS. 2, 3, the present invention comprises a solid shaft 2, a pair of opening locks 3, a runner 4 and a top cap 5 wherein the runner 4 is associated with a plurality of pivotally operated stretching ribs 42 each of which is connected at a proper position to a support rib 51 that is then pivotably fixed to the top cap 5. The runner is provided with a through hole 41 so as to permit the solid shaft 2 to go therethrough with the top cap 5 attached to the top end thereof. This is a commonly known prior art and a detailed description is not necessary.

The present opening lock is positioned in each T shaped cavity 21 disposed on two sides and the top of the solid shaft 2 respectively. The opening lock 3 is comprised of a cover plate 31 and a spring biased stop block 32, a spring 33 and a fixing element 34. The fixing element 34 has a plate 341 having a round protrusion 342 disposed thereon and is just fitted in the end portion of the T shaped cavity 21, and the spring 33 is associated with the fixing element 34 with the end thereof engaged with the round protrusion 342 so as to restrict the spring in position and prevent the spring 33 from dislocation due to long time operation and ensure the quality of the spring. The stop block 32 has a protrusion head 321 having a smoothly curved bottom defined in such a manner that when the runner 4 is pushed from below the stop block 32, the protrusion head 321 will be urged to slide into the T shaped cavity 21 so as to permit the runner to pass over the stop block 32. Right behind the protrusion head 321 is disposed a stop flange 322 and a cylindrical protrusion 323 extending from the protrusion head 321 is disposed in correspondence to the round protrusion 342 so that the spring 33 can be held in position between the stop block 32 and the fixing element 34.

The cover plate 31 has a central opening 311 through which the protrusion head 321 is led and a pointed pin 312 disposed on each corner of the side facing the T shaped cavity 21 so that the stop block 32 and the spring 33 and the fixing element 34 can be operatively confined in the T shaped cavity 21 with the protrusion head 321 going through the central opening 311. The cover plate 31 is secured to the wall to the shaft 2 by way of the pointed pins 312 so as to confine the stop block in the T shaped cavity 21.

Figure 4:
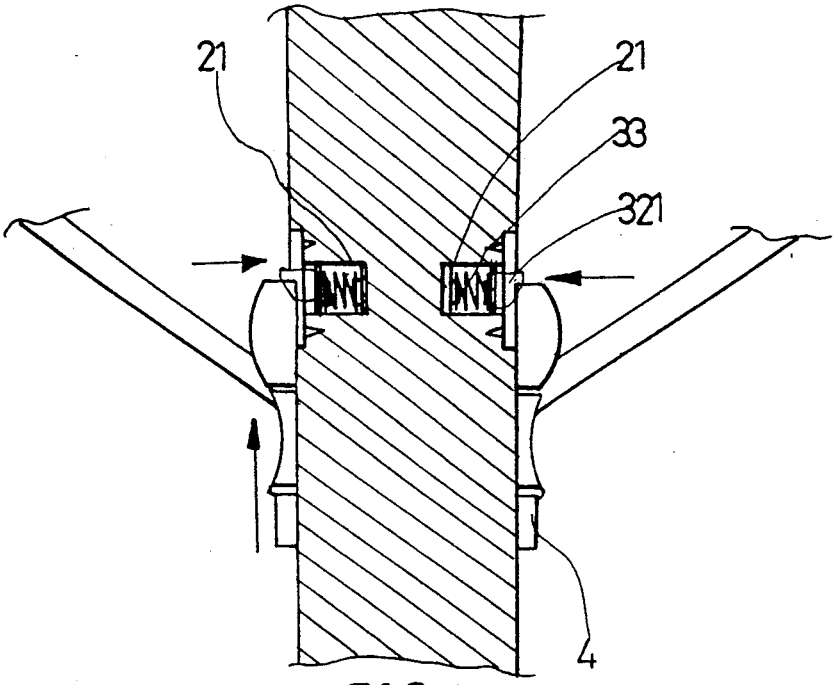
FIG. 4 is a diagram showing the runner of the sunshade travelling over the present opening lock.
Figure 5:
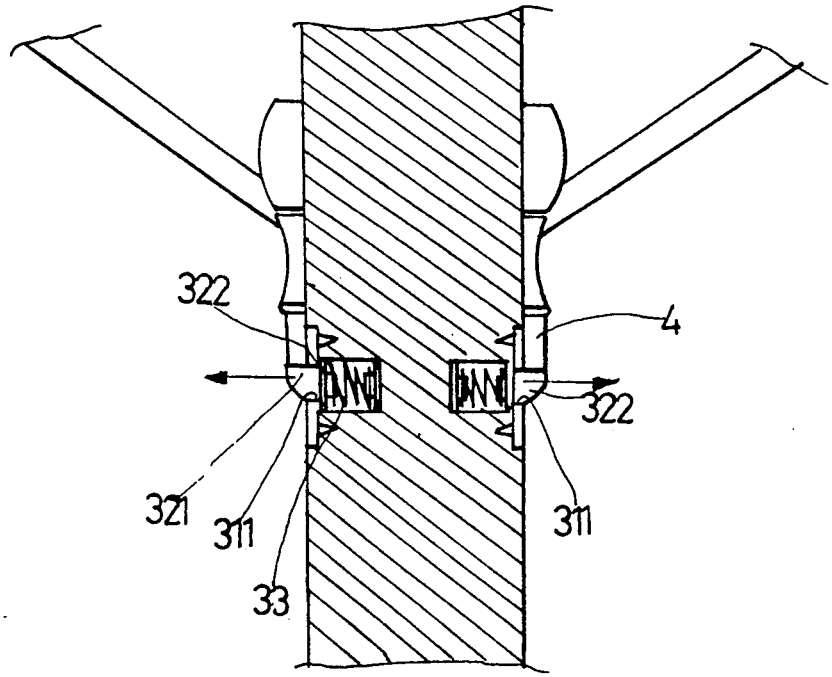
FIG. 5 is a diagram showing the runner of the sunshade supported by the stop block of the present opening lock.

Referring to FIGS. 4, 5, when the sunshade is to be opened, the runner 4 is pushed upward in abutment against the smoothly curved guide bottom of the protrusion head 321 so as to force the same to slide into the T shaped cavity 21, making the spring 33 compressed, thereby the runner 4 can pass over the stop blocks 32 disposed on two sides of the shaft 2, as shown in FIG. 4.

Furthermore, after the runner 4 passes the spring biased protrusion head 321, the same will pop out of the central opening 311 by way of the spring 33 pushing against the stop flange 322 and hold the runner 4 in place as shown in FIG. 5, and the opening of the sunshade is completed.

To make the sunshade closed or collapsed, the operator only has to push the protrusion heads 321 of the stop blocks 32 into the T shaped cavities 21 by fingers and pull the runner 4 downward.

Figure 6:
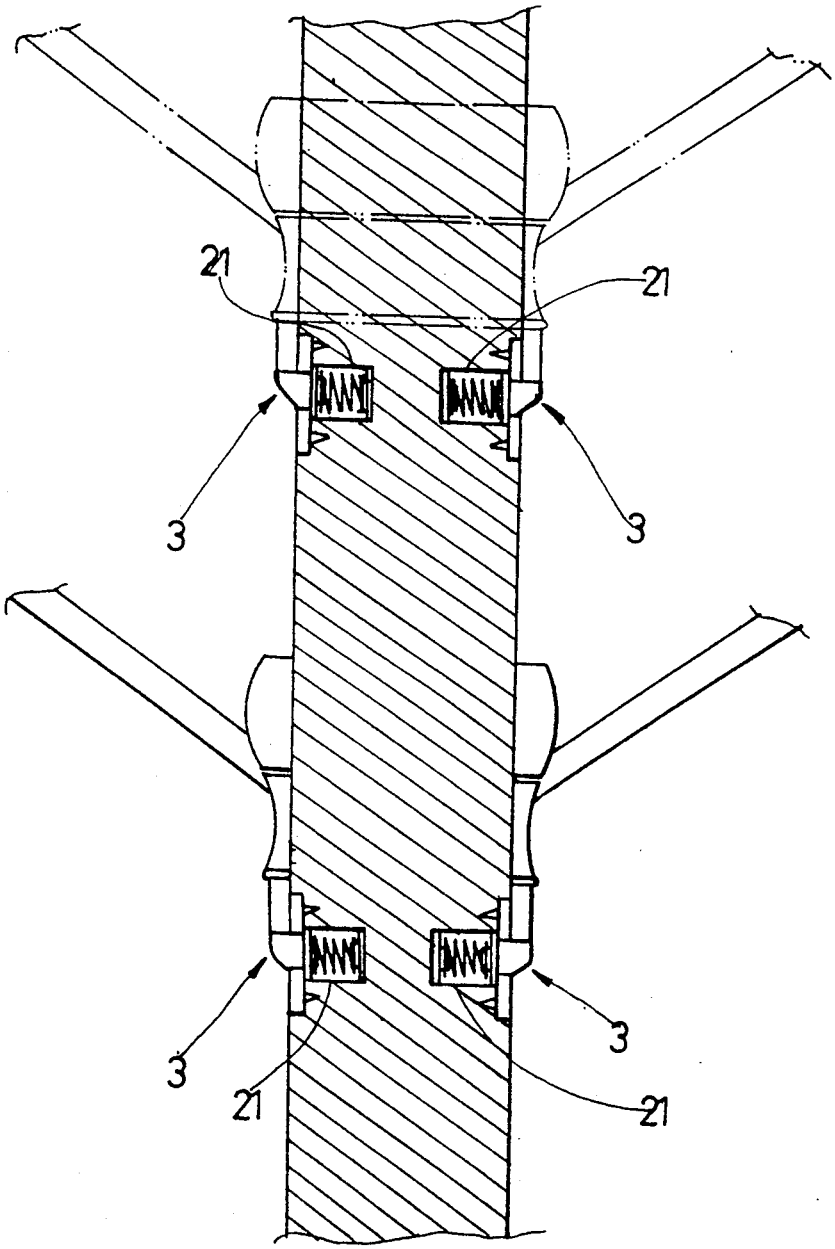
FIG. 6 is a diagram showing the sunshade being able to be selectively opened.

As further shown in FIG. 6, the shaft 2 can be provided with two sets of the paired cavities 21 that are at a distance of 12 to 15 centimeters with the opening locks 3 disposed therein respectively so as to permit the sunshade to be selectively opened.

Figure 7:
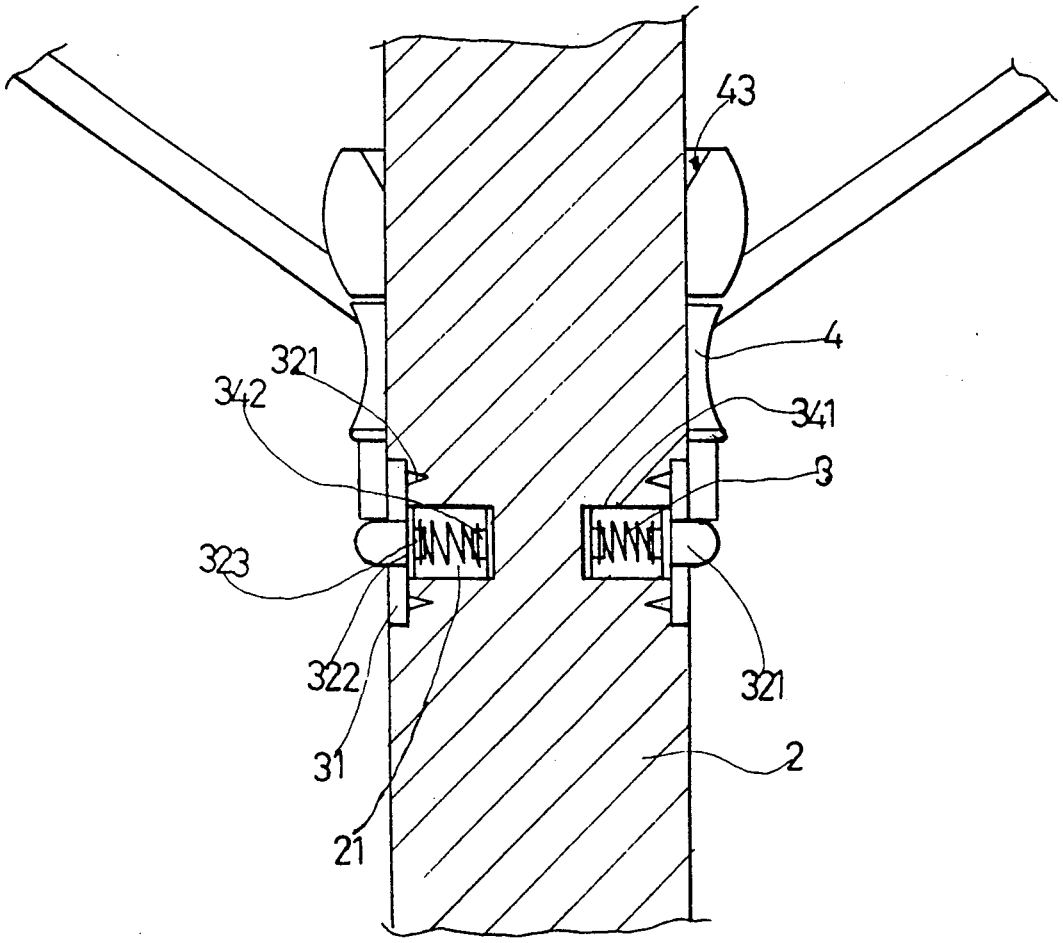
FIG. 7 is a diagram showing a second embodiment of the present invention.

Referring to FIG. 7, a second embodiment of the present invention is illustrated. The inner periphery of the front end of the through hole 41 of the runner 4 is provided with a tapered face 43; and the protrusion head 321 is defined in a smooth bullet-like shape so that the runner 4 can move against the protrusion head 321 of the stop block 32 when pushed upwards and slide over the stop block 32 with ease, permitting the sunshade to be opened with less effort.

I claim:

1. An improved opening lock particularly for a sunshade of a parasol, comprising:

a solid shaft having a pair of symmetric T shaped cavities disposed on two sides near the top thereof;

a cover plate having a central opening and a number of securing means disposed on one side thereof so as to firmly associated with the wall of said T shaped cavity;

a stop block having a protrusion head which is provided with a smoothly curved guide bottom and a stop flange disposed between said protrusion head and a cylindrical protrusion extended from said protrusion head;

a spring disposed in abutment against said stop block with one end of thereof in association with said cylindrical protrusion and the other with a round protrusion disposed on a fixing element so that said stop block can be retractably actuated;

said fixing element being disposed in the end portion of said T shaped cavity;

said protrusion head being disposed through said central opening of said cover plate and being in abutment with the upward pushed runner slidably disposed on said shaft in the opening process of said sunshade with said smoothly curved guide bottom of said protrusion head in urging contact with said runner and the upward push of said runner leading to the sliding of said stop block into said T shaped cavity so as to permit said runner to pass said opening lock and said pressed stop block being able to pop out of said central opening of said cover plate and support said runner in place.

2. An improved opening lock for a sunshade as claimed in claim 1 wherein said solid shaft of the sunshade can be provided with a number of sets of paired symmetric T shaped cavities thereon so as to permit said sunshade to be selectively opened.

3. An improved opening lock for a sunshade as claimed in claim 1 wherein said solid shaft of the sunshade is provided with a couple of sets of paired symmetric T shaped cavities thereon so that said sunshade can be selectively opened.

4. An improved opening lock for a sunshade as claimed in claim 1 wherein the inner pheriphery at the top end of the through hole of said runner is disposed a tapered face which can be in smooth contact with a bullet like protrusion head of said stop block of opening lock when pushed upwards and can run over the same with ease when the sunshade is opened.

* * * * *